United States Patent [19]

Malagari, Jr.

[11] 3,954,521

[45] May 4, 1976

[54] METHOD OF PRODUCING GRAIN ORIENTED SILICON STEEL

[75] Inventor: Frank A. Malagari, Jr., Freeport, Pa.

[73] Assignee: Allegheny Ludlum Industries, Inc., Pittsburgh, Pa.

[22] Filed: Aug. 19, 1974

[21] Appl. No.: 498,798

Related U.S. Application Data

[63] Continuation of Ser. No. 785,873, Dec. 23, 1968, abandoned.

[52] U.S. Cl. ..... 148/111; 148/112; 148/31.55; 75/123 L

[51] Int. Cl.[2] ..... H01F 1/04

[58] Field of Search ..... 148/110, 111, 112, 113, 148/31.55, 12.1; 75/123 L

[56] References Cited

UNITED STATES PATENTS

| | | | |
|---|---|---|---|
| 2,867,557 | 1/1959 | Crede et al. | 148/111 |
| 3,021,237 | 2/1962 | Henke | 148/111 |
| 3,151,005 | 9/1964 | Alworth et al. | 148/111 |
| 3,159,511 | 12/1964 | Taguchi et al. | 148/111 |
| 3,207,639 | 9/1965 | Mobiss | 148/113 |
| 3,239,332 | 3/1966 | Goss | 148/111 |

*Primary Examiner*—Walter R. Satterfield
*Attorney, Agent, or Firm*—Vincent G. Gioia; Robert F. Dropkin

[57] ABSTRACT

The application describes a process for producing grain oriented silicon steel wherein advantages are realized from the utilization of starting material with a relatively high carbon content. The process involves a series of steps including hot rolling, heat treating, cold rolling, normalizing, decarburizing and annealing.

3 Claims, 2 Drawing Figures

METHOD OF PRODUCING GRAIN ORIENTED SILICON STEEL

This application is a continuation of previously copending application Ser. No. 785,873 filed Dec. 23, 1968 , and now abandoned.

The invention relates to the production of silicon steel and more particularly to the production of grain oriented silicon steel, containing about 2 to 4% silicon.

Silicon steels are widely used in electrical equipment because of their high permeability, high electrical resistance, and low hysteresis loss. Their manufacture requires a careful control of composition since nearly all elements, when added to iron, adversely affect magnetic properties. For example, impurities such as nitrogen, oxygen, sulphur, and carbon cause dislocations in the crystal lattice which build up detrimental internal stresses. Considered worst of all the elements is carbon.

I have found, however, that there are certain advantages to utilizing a silicon steel with a relatively high carbon content during fabrication stages and that following working to gauge, the steel can be decarburized to a level consistent with good electrical properties. These advantages include the following: (1) improved magnetic properties such as lower core loss and higher permeability; (2) less iron oxide in the slag and consequently a higher metallic yield; (3) lower oxygen consumption during refining; (4) longer refractory life; (5) less breakage during cold rolling as the material is more ductile since the hot rolled band recrystallizes to a greater degree in higher carbon material; and (6) higher tolerances for carbon in melting. Prior to the present invention, silicon steel making required melting and fabricating the steel with low carbon, i.e. less than about 0.025%. It has now been found that silicon steel meeting existing low carbon specifications can be produced by starting with a relatively high carbon steel and with advantageous results both with respect to improved fabricability and superior electrical properties of the final product. An attempt at utilizing higher carbon content is described in U.S. Pat. No. 3,151,005 issued on Sept. 29, 1964. It, however, requires a critical drastic quench and subsequent heat treatment to develop a particular type of carbide necessary for the development of magnetic properties. Hence, the patent describes a process which is not easily adaptable to continuous production, which is inherently more economical.

It is accordingly an object of this invention to provide a new process for producing grain oriented silicon steel.

It is another object of this invention to provide a process for producing grain oriented silicon steel wherein the starting material is a steel with a relatively high carbon content.

The foregoing and other objects of the invention will be best understood from the following description, reference being had to the accompanying drawings, wherein.

Figure 1:
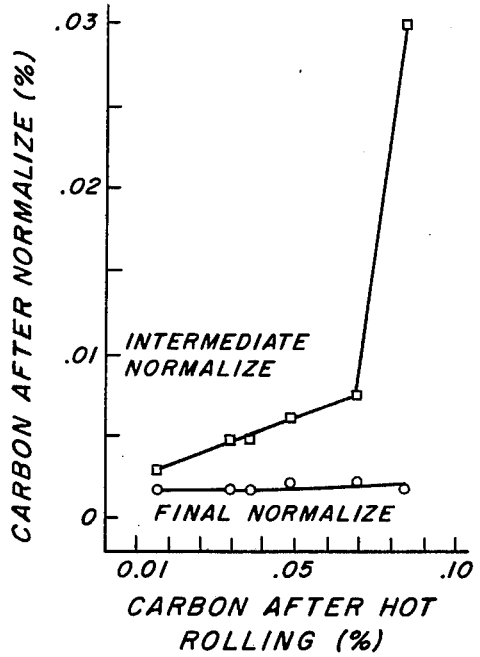
FIG. 1 is a graph showing the change in carbon of material processed according to this invention at various stages of production.

According to the present invention, a silicon steel member containing between about 0.03 to 0.07% C is heated to a temperature in excess of 2050°F, preferably in excess of 2350°F, and then hot rolled. After hot rolling, the member is heat treated by holding it for at least abour 30 seconds at a temperature in excess of 1600°F, preferably in excess of 1650°F, and cooling it without quenching. The cooling medium is gaseous and can be air, an inert gas such as argon or nitrogen, a reducing gas such as hydrogen, or a mixture of gases such as 80% $N_2$ –20%$H_2$. Subsequently, the member undergoes a series of cold rolling, normalizing and decarburizing treatments, preferably two of each, with a normalizing treatment following each cold rolling. The normalizing treatments take place at a temperature in excess of 1400°F. The last step is a final anneal at a temperature in excess of 1600°F, preferably in excess of 2000°F, for proper development of magnetic properties. The process described lends itself to continuous operation since no special heat treatments and quenches are required which would interfere with in line processing.

As mentioned above, in practicing the invention silicon steel is melted to a relatively high carbon level. Although it is not entirely clear why higher initial carbon content leads to superior electrical properties in the lower carbon final product, they may be due to an increased proportion of austenite present during hot rolling. The carbon in the final product, however, must be reduced to a level not greater than about 0.005%, preferably 0.003%, during processing. Decarburization can be a separate operation within the continuous process or can occur during the heat treatment after hot rolling or during the normalizing treatments which follow cold rolling, with the aid of a decarburizing atmosphere such as 80% nitrogen–20% hydrogen.

The following examples will illustrate several embodiments of the invention. A series of samples were prepared from induction heats. The analysis of these samples is shown in Table I.

TABLE I

| Steel | C | Mn | P | S | Si |
|---|---|---|---|---|---|
| A | .007 | .055 | .008 | .020 | 3.44 |
| B | .030 | .055 | .008 | .020 | 3.44 |
| C | .036 | .055 | .008 | .021 | 3.44 |
| D | .048 | .055 | .008 | .020 | 3.44 |
| E | .069 | .056 | .006 | .021 | 3.28 |
| F | .084 | .057 | .006 | .021 | 3.31 |

The samples were heated to 2400°F, held 30 minutes at temperature in either argon or hydrogen and hot rolled in 3 to 4 passes to a 0.080 inch thick band. After hot rolling, the bands were heat treated at 1830°F for 30 minutes and cooled without quenching. Cold rolling to an intermediate gauge of 0.028 inch followed. The steel was then normalized in an 80% $N_2$–20% $H_2$ (+40°F dew point) at 1725°F for 2 minutes. After this it was cold rolled to gauge (0.0108inch) and given a final normalize in an 80% $N_2$–20% $H_2$ (+80°F to +100°F dew point) at 1475°F for 1 minute. The final operation was a texture anneal by the following steps: (1) heat in argon at 150°F per hour to 1830°F from 1400°F; (2 ) hold for 1 hour at this temperature; (3) replace argon with hydrogen; (4) heat to 2150°F in hydrogen at 150°F per hour; (5) hold for 8 hours at this temperature; and (6) furnace cool.

Decarburization took place during the normalizing treatments and the results of such are shown in Table II. It should be noted that all specimens had a final carbon content of under 0.003. The change in carbon content is graphically shown in FIG. 1.

TABLE II

| Steel | Hot Rolled Band % C | After Intermediate Normalize % C | After Final Normalize |
|---|---|---|---|
| A | .0070 | .0030 | .0018 |
| B | .0300 | .0049 | .0019 |
| C | .0360 | .0049 | .0018 |
| D | .0480 | .0062 | .0022 |
| E | .0690 | .0077 | .0023 |
| F | .0840 | .0300 | .0020 |

Figure 2:
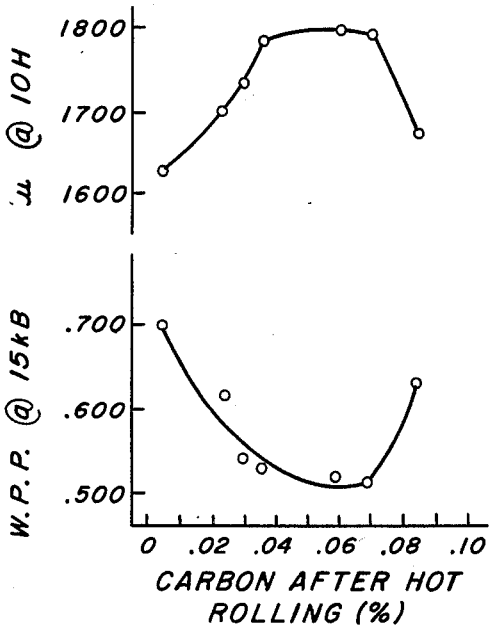
FIG. 2 is a graph showing the effect of carbon on magnetic properties of material processed according to this invention.

Magnetic properties for the processed specimens are shown in Table III. As can be seen, there is an improvement in core loss and permeability as the carbon increases up to 0.069% with deterioration of these properties at 0.084% carbon. Steel B with 0.030% carbon has considerably lower core loss and higher permeability than Steel A with 0.007% carbon. Likewise, Steel C with 0.036% carbon, attained a higher permeability (1781) and lower core loss (0.521) than did Steels A and B. Similarly, Steel E with 0.069 carbon has considerably lower core loss and higher permeability than Steel F with 0.084% carbon. The effect of increased carbon on magnetic properties can be seen graphically in FIG. 2.

TABLE III

| Steel | Band C % | Core Loss 60 ~ WPP at 15 KB | Permeability 60 ~ $\mu$ at 10H |
|---|---|---|---|
| A | .007 | .695 | 1617 |
| B | .030 | .537 | 1737 |
| C | .036 | .521 | 1781 |
| D | .048 | .508 | 1753 |
| E | .069 | .503 | 1793 |
| F | .084 | .628 | 1673 |

Additional induction heats containing 0.05% carbon with 0.06, 0.12 and 0.20 manganese were processed to strip for magnetic property evaluation to test the effect of increased manganese. This testing was motivated by the fact that increased carbon brings increased manganese into the melt unless there is additional refining to lower such. From an economical standpoint it would be advantageous to tolerate a higher manganese percentage. Lower carbon heats used in the past commonly contained 0.06% manganese while mill heats with 0.05% carbon could contain from 0.10 to 0.12% manganese. Table IV shows the analysis for these heats and Table V shows the results of this work. A study of Table V shows that no adverse effects were realized from the increased manganese up to a level of about 0.20%. However, as evidenced by steels J + K, as 0.35% and 0.49% manganese, there is a breakdown of magnetic properties.

TABLE IV

| Heat | C | Mn | P | Al | S | Si | PPM O | PPM N |
|---|---|---|---|---|---|---|---|---|
| G | .055 | .06 | .006 | .005 | .022 | 3.27 | 44 | 6 |
| H | .050 | .12 | .006 | .005 | .023 | 3.25 | 50 | 10 |
| I | .053 | .20 | .007 | .005 | .022 | 3.24 | 57 | 8 |
| J | .050 | .35 | .007 | .005 | .019 | 3.29 | 50 | 7 |
| K | .051 | .49 | .007 | .005 | .020 | 3.29 | 49 | 2 |

TABLE V

| Steel | % Mn | Core Loss 60 ~ WPP at 15 KB | | Permeability 60 ~ $\mu$ at 10 H | |
|---|---|---|---|---|---|
| G | .06 | .567 | .522 | 1781 | 1798 |
| H | .12 | .538 | .510 | 1800 | 1807 |
| I | .20 | .545 | .517 | 1792 | 1798 |
| J | .35 | .618 | .678 | 1657 | 1648 |
| K | .49 | .612 | .665 | 1670 | 1648 |

It will be apparent to those skilled in the art that the novel principles of the invention disclosed herein in connection with specific examples thereof will suggest various other modifications and applications of the same. It is accordingly desired that in construing the breadth of the appended claims they shall not be limited to the specific examples of the invention described herein.

Having thus described the invention, what I claim is:

1. A process for producing grain oriented silicon steel containing not more than about 0.005% carbon comprising the following steps:

a. heating steel containing between 0.036 and 0.07% carbon and between 2 and 4% silicon at a temperature in excess of 2350°F;
b. hot rolling said steel;
c. heat treating said steel at a temperature in excess of 1600°F for at least about 30 seconds;
d. cooling said steel in a gaseous medium, without quenching;
e. cold rolling said steel;
f. normalizing said steel at a temperature in excess of 1400°F;
g. decarburizing said steel to a carbon level not greater than about 0.005% carbon; and
h. final annealing said steel.

2. A process according to claim 1 wherein said steel is decarburized by normalizing in a decarburizing atmosphere.

3. A process according to claim 1 wherein said cold rolling and normalizing comprises two cold rolling operations each succeeded by a normalizing treatment.

* * * * *